US012270177B2

(12) United States Patent
Van Der Schaaf et al.

(10) Patent No.: US 12,270,177 B2
(45) Date of Patent: Apr. 8, 2025

(54) PILE DRIVING APPARATUS

(71) Applicant: Foundiz B.V., Etten-Leur (NL)

(72) Inventors: Peter Hendrik Van Der Schaaf, Etten-Leur (NL); Arjen Hans Van Der Schaaf, Etten-Leur (NL)

(73) Assignee: Foundiz B.V., Etten-Leur (NL)

( * ) Notice: Subject to any disclaimer, the term of this patent is extended or adjusted under 35 U.S.C. 154(b) by 136 days.

(21) Appl. No.: 18/153,438

(22) PCT Filed: Jul. 15, 2020

(86) PCT No.: PCT/NL2020/000013
§ 371 (c)(1),
(2) Date: Jan. 12, 2023

(87) PCT Pub. No.: WO2022/015158
PCT Pub. Date: Jan. 20, 2022

(65) Prior Publication Data
US 2024/0011235 A1 Jan. 11, 2024

(51) Int. Cl.
*E02D 7/18* (2006.01)
*E02D 7/26* (2006.01)

(52) U.S. Cl.
CPC ..... *E02D 7/18* (2013.01); *E02D 7/26* (2013.01)

(58) Field of Classification Search
CPC ..... E02D 7/18; E02D 7/26
See application file for complete search history.

(56) References Cited

U.S. PATENT DOCUMENTS 4,626,138 A * 12/1986 Boyes ..... E02D 7/20 405/230
6,691,797 B1 * 2/2004 Hart ..... E02D 11/00 173/128

FOREIGN PATENT DOCUMENTS

| | | | |
|---|---|---|---|
| DE | 20203336 | U1 | 5/2002 |
| DE | 202018106039 | U1 | 11/2018 |
| JP | S4930925 | B1 | 8/1974 |
| JP | S569522 | A | 1/1981 |
| JP | H05112935 | A | 5/1993 |
| JP | H09268557 | A | 10/1997 |

OTHER PUBLICATIONS

International Search Report and Written Opinion from Application No. PCT/NL2020/000013 dated Apr. 15, 20201.

* cited by examiner

*Primary Examiner* — Sean D Andrish
(74) *Attorney, Agent, or Firm* — Troutman Pepper Locke LLP; Ryan A. Schneider; Andrew C. Doherty

(57) ABSTRACT

A pile driving apparatus and method for driving a pile into ground. The apparatus includes a vertical guide mast, a support carriage displaceable along the mast, a vibration hammer, a rotator coupling and a tilt coupling connected between the support carriage and the vibration hammer. The vibration hammer includes first clamping means arranged at the side of a hammer main body, adapted for holding and clamping a pile at any position along a length of the pile second clamping means arranged at the lower end of the hammer main body, adapted for holding and clamping the pile at a top end of the pile. The method includes driving the support carriage to a relatively low position, operating the first clamping means, first operating the vibration hammer, driving the support carriage to a higher position, operating the second clamping means, and second operating the vibration hammer.

10 Claims, 4 Drawing Sheets

PILE DRIVING APPARATUS

FIELD OF THE INVENTION

The present invention relates in general to the art of driving piles into the ground by vibration, or, oppositely pulling such pile out of the ground by vibration.

BACKGROUND OF THE INVENTION

For driving such piles, it is commonly known to use a vibration hammer. Vibration hammers, also known as vibratory hammers, are known, heavy devices, which are clamped onto the pile and are capable of generating a vibration resulting in driving forces in the longitudinal direction of the pile. Typically, such vibration hammer has clamping means arranged at its lower side, and is placed on top of the standing pile, carried by a lifting apparatus.

One particular field of application for driving piles into the ground is the use of sheet pile profiles for creating a foundation dam or retaining wall. Such piles have a certain profile for interlocking with each other to provide a water sealing, and their placement has to be done rather accurately. For this purpose, the vibration hammer is guided along a guide mast, which is held vertically in position, usually by a manipulation vehicle.

Generally, adjacent sheet pile profiles will be placed in the same orientation. Thus, the guide mast can always be held in approximately the same orientation, and the support vehicle only needs to displace the mast over a short distance to be ready to place the next sheet pile profile. This works conveniently, as long as the sheet pile profiles are to be arranged substantially along a straight line. A problem arises, however, in case the wall to be built makes a corner, i.e. a location where adjacent sheet pile profiles make an angle with respect to each other. For placing the next sheet pile profile, it now is necessary to rearrange the guide mast so that it makes a corresponding angle with respect to its own orientation as used in placing the previous sheet pile profile. This can be done by rearranging the entire manipulation vehicle, which in itself is inconvenient, but usually there is not even any maneuvering space for doing this. Therefore, the mast is typically provided with rather expensive hinging means for allowing the mast to be hinged or rotated about a vertical axis with respect to the vehicle.

A further problem with the known apparatus is that a separate lifting device is required for placing a new pile alongside the mast, in order to allow the vibration hammer to be placed on top of the upper end of the standing pile. The maximum length of the piles to be handled is thus determined by the height of the lifting apparatus and by the height of the vertical mast.

Further, while the new pile is standing and the vibration hammer is placed on top of the pile, the vibration hammer has to be clamped on the top of the pile. Operating personnel will be standing on ground level, and it is difficult for them to see whether or not the clamping is done correctly.

SUMMARY OF THE INVENTION

The present invention aims to provide a solution to the above problems.

According to an important aspect of the present invention, the guide mast is provided with a support structure that is vertically displaceable along the guide mast in a guided manner. This guidance may be a sliding guidance, but may also for instance include roller bearings or wheel bearings.

Said structure may be referred to as a sled or a bracket, but will hereinafter be indicated as a carriage.

The vibration hammer is suspended from this support carriage. Further, the vibration hammer is provided with clamping means at its side in addition to clamping means at its bottom.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
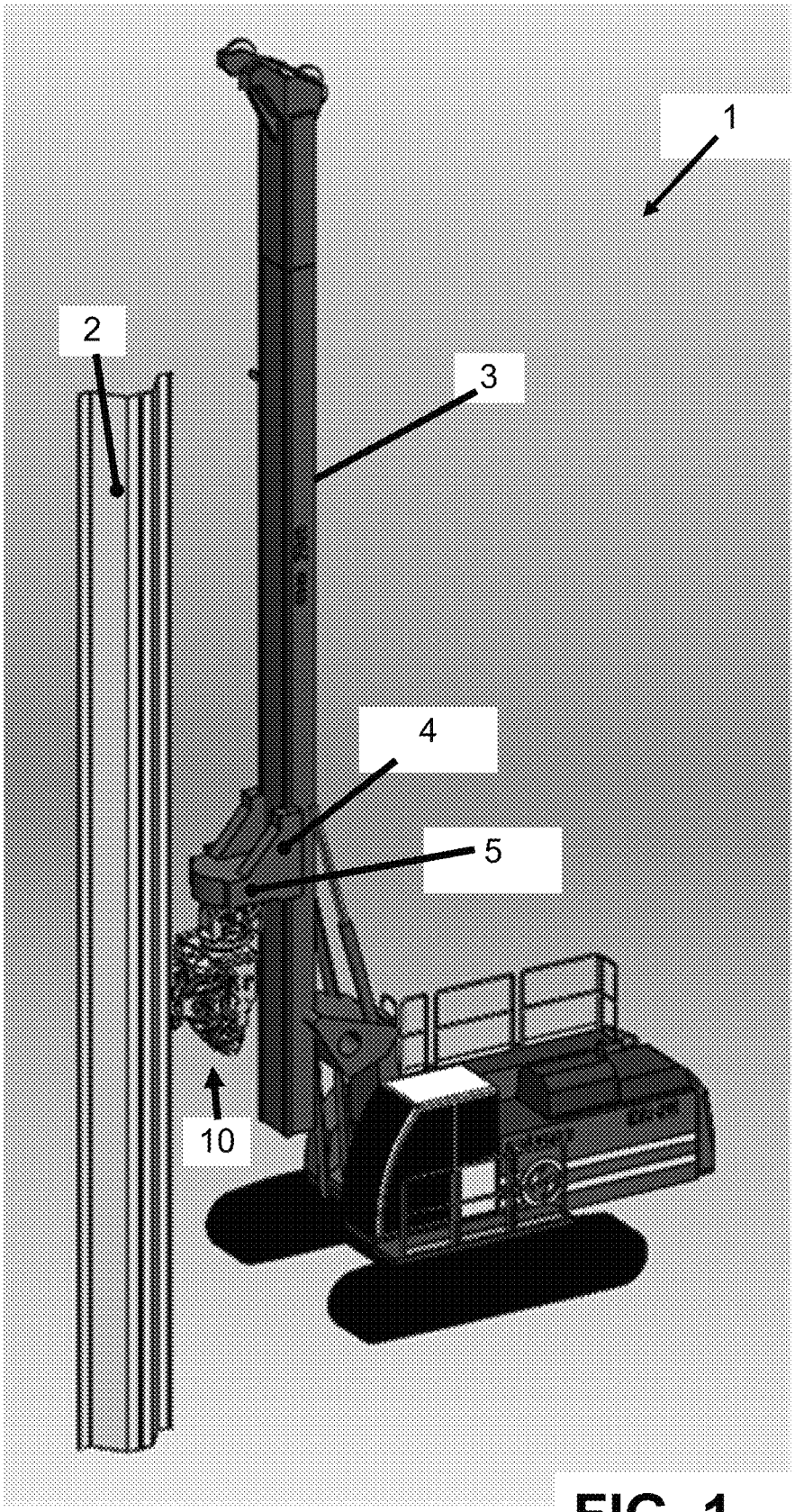
FIG. 1 is a perspective view schematically illustrating a pile driving apparatus in accordance with the present invention.

FIG. 1 is a perspective view schematically illustrating a pile driving apparatus 1 in accordance with the present invention. The pile driving apparatus 1 comprises a pile driving vehicle, typically a tracked vehicle, that holds and lifts a guide mast 3. A support carriage 4 is vertically displaceable along the mast 3, being guided by the mast 3. Carriage driving means for driving the support carriage 4 along the mast 3 are not shown for sake of simplicity. The support carriage 4 comprises, in the embodiment shown, a support platform 5 extending substantially horizontally from the mast 3. A vibration hammer 10 in accordance with the present invention is attached to and suspended from the lower side of the carriage, i.e. the lower side of this platform 5 in the embodiment shown.

Figure 2:
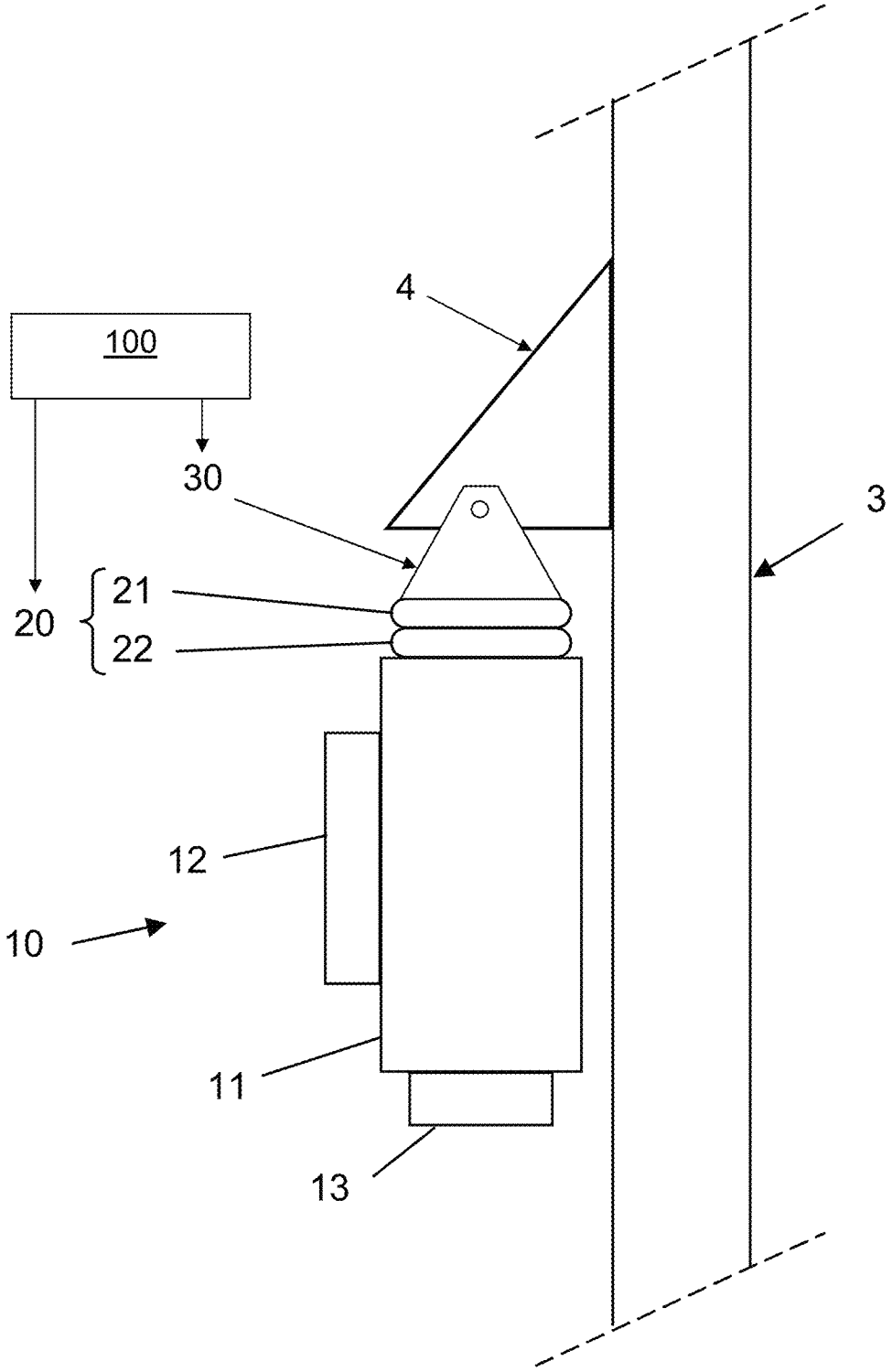
FIG. 2 schematically illustrates a vibration hammer.

FIG. 2 is a schematic illustration of a vibration hammer 10.

The vibration hammer 10 comprises a hammer main body 11 that comprises a vibrations generator capable of generating the driving vibrations. Since the technology for generating driving vibrations is known per se, the components for generating the vibrations are not shown for sake of simplicity.

The vibration hammer 10 further comprises first clamping means 12 arranged at a side of the hammer main body 11, and second clamping means 13 arranged at a lower end of the hammer main body 11. The first clamping means 12, also indicated as side clamping means 12, are adapted for holding and clamping a pile at any position along the length of such pile. The first clamping means 12 will typically have hydraulic claws of which the shape is adapted to the shape of the pile to be held. Likewise, the second clamping means 13, also indicated as top clamping means 13, are adapted to hold and clamp the upper end of the pile, and have hydraulically operated claws of which the shape is adapted to the cross sectional shape of the pile concerned.

The precise shape and nature of the clamping claws of the side and top clamping means 12 and 13 is not essential, therefore the drawings do not contained a detailed illustration in this respect. It may be noted that these claws may be adapted to the shape of the pile to be processed: this may be a flat sheet-like shape, but the invention is also applicable to the case where the piles are tubular. It is noted that it is an important feature of the clamping claws that they are capable of transferring the hammer's vibration forces without losing their grip on the pile.

An important aspect of the present invention is that the vibration hammer 10 main body 11 is, at its upper side, attached to the lower side of the support platform 5 in such manner as to be rotatable around a vertical axis with respect to the support platform 5, and about a horizontal axis with respect to the support platform 5. Typically, the lower side of the support platform 5 may be provided with a tilt coupling 30, hingedly attached to the lower side of the support platform 5 with a horizontal hinge axis, and a rotator coupling 20, having an upper part 21 fixed to the lower side of the tilt coupling 30 and having a rotatable lower part 22 fixed to the upper side of the main body 11. In an alternative approach, the rotator coupling 20 is part of the main body 11. The upper part 21 and lower part 22 comprise drive means (not shown) for adjusting and holding the rotational position of the lower part 22 with respect to the upper part 21. Likewise, the tilt coupling 30 is provided with tilting drive means (not shown) for adjusting and holding the tilt angle with respect to a corresponding horizontal hinge axis. As shown in FIG. 2, apparatus 1 is provided with control means 100 for controlling the operation of these drive means. An operator can actuate these control means and can thus set the orientation of the pile 2 without needing to change the orientation of the mast 3. Particularly, the vibration hammer 10 is capable of being positioned with a pile lying on the ground, to pick up that pile, and to lift it and tilt it to vertical orientation, and to rotate the pile about a vertical axis.

Operation is as follows.

In a first stage, an operator controls the carriage driving means to drive the support carriage 4 to a relatively low receiving position along the mast 3, and manipulates the couplings 20 and 30 to put the vibration hammer 10 in a position for picking up a pile. The operator controls the side clamping means 12 of the hammer main body 11 to clamp a side portion of the pile 2. Since the receiving position of the support carriage 4 is relatively low, the operator can easily inspect visually whether the side clamping means 12 clamp the pile correctly and safely.

Figure 3A:
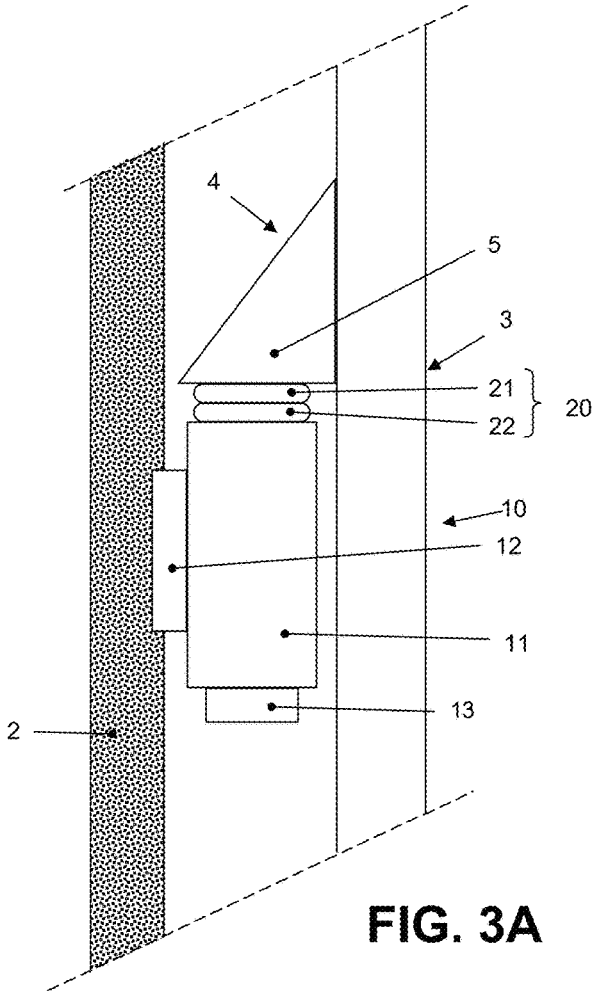
FIGS. 3A and 3B schematically illustrate operation of the vibration hammer.

Subsequently, the operator controls the driving means for the carriage and the couplings 20 and 30 to lift the pile and put the pile in a vertical orientation, as shown in FIG. 3A. For sake of convenience, the tilt coupling 30 is not shown in FIG. 3A.

In a second stage, the mast 3, with the support carriage 4 and the clamped pile 2, is brought to the destination location where the pile is to be driven into the ground.

In a third stage, the operator controls the carriage driving means for the support carriage 4 and the vibrations generator of the vibration hammer 10 to drive the pile 2 downwards into the ground while being clamped by the side clamping means 12. It is noted that the support carriage 4 follows the lowering of the pile 2.

The pile is forced into the ground by the combined influence of the longitudinal vibrations and a steady downwards force provided by gravity, i.e. the weight of the pile and the support carriage 4. There may be provision of an additional steady downwards force. One example of force means for exerting downwards force is one or more cylinder-driven, preferably hydraulic, telescopic arms that are coupled between the mast 3 and the support carriage 4 and that exert downwards force on the support carriage 4. Another example of such force means is in the carriage driving means that drive the support carriage 4 along the mast 3; these driving means can also be actuated while the support carriage 4 can not move down because of the pile, so that the support carriage 4 effectively pushes down on the pile. The carriage driving means may be any suitable driving means, for instance they may be implemented as a cable pulled by a winch, or as a combination of a motor-driven cogwheel with a rack.

Said additional force means may also be operated in opposite direction for pulling piles out of the ground.

At regular intervals, the vibrations generator may be interrupted, the side clamping means 12 may be released, and the operator may control the carriage driving means to drive the support carriage 4 to a higher position, so that the side clamping means 12 can again clamp the pile 2, and vibrating/driving is resumed.

Figure 3B:
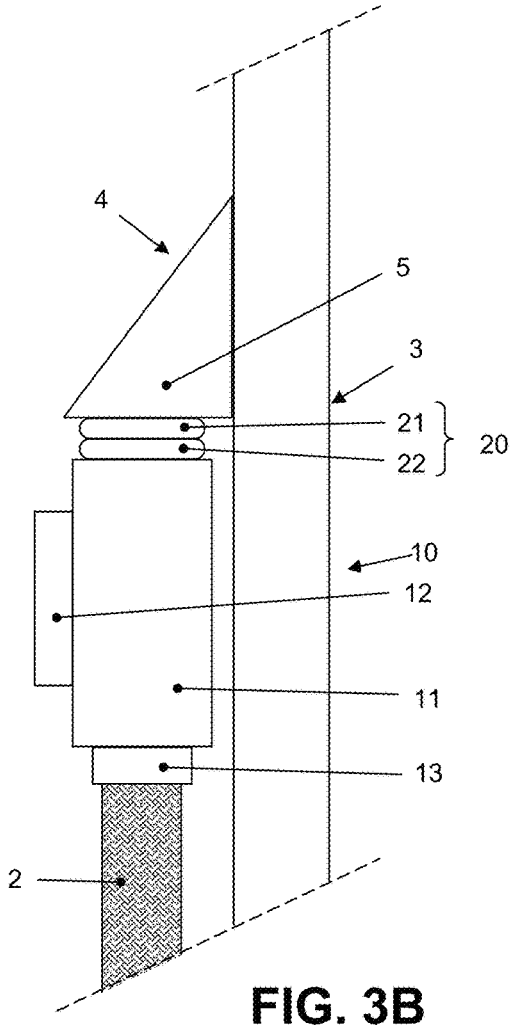

In a fourth stage, when the pile 2 has been driven into the ground to such extent that its top is at a sufficiently low position, the side clamping means 12 are released, the support carriage 4 is driven to a position above the pile 2, and the top of the pile 2 is clamped by the top clamping means 13, as illustrated by FIG. 3B. Vibrating and downwards driving is now resumed, and in principle the pile 2 can now be driven all the way down into the ground.

Often, however, an upper portion of the pile 2 is to remain extending above ground level. It is noted that in such case it may be unnecessary to use the top clamping means 13 but finish operations with the side clamping means 12 alone.

In the above, normal pile loading and driving operation of the pile driving apparatus 1 in accordance with the present invention has been described. A particular advantage of the pile driving apparatus 1 in accordance with the present invention is that it easily allows adjusting or setting an orientation of the pile 2 with respect to a vertical axis, i.e. the longitudinal direction of the pile 2, by operating the rotator coupling 20. Thus, without requiring the entire guiding mast to be displaced, a next pile can be rotated, by rotating the rotator coupling 20, about a vertical axis to take any orientation with respect to its neighbour. For instance, piles can be set at an angle of 90 degrees to define a corner of a casing.

It is to be noted that the positioning accuracy of the system is ensured by the fact that the gripping means for gripping the pile, by virtue of being mounted to the vehicle 4, are always guided along the mast 3.

Figure 4:
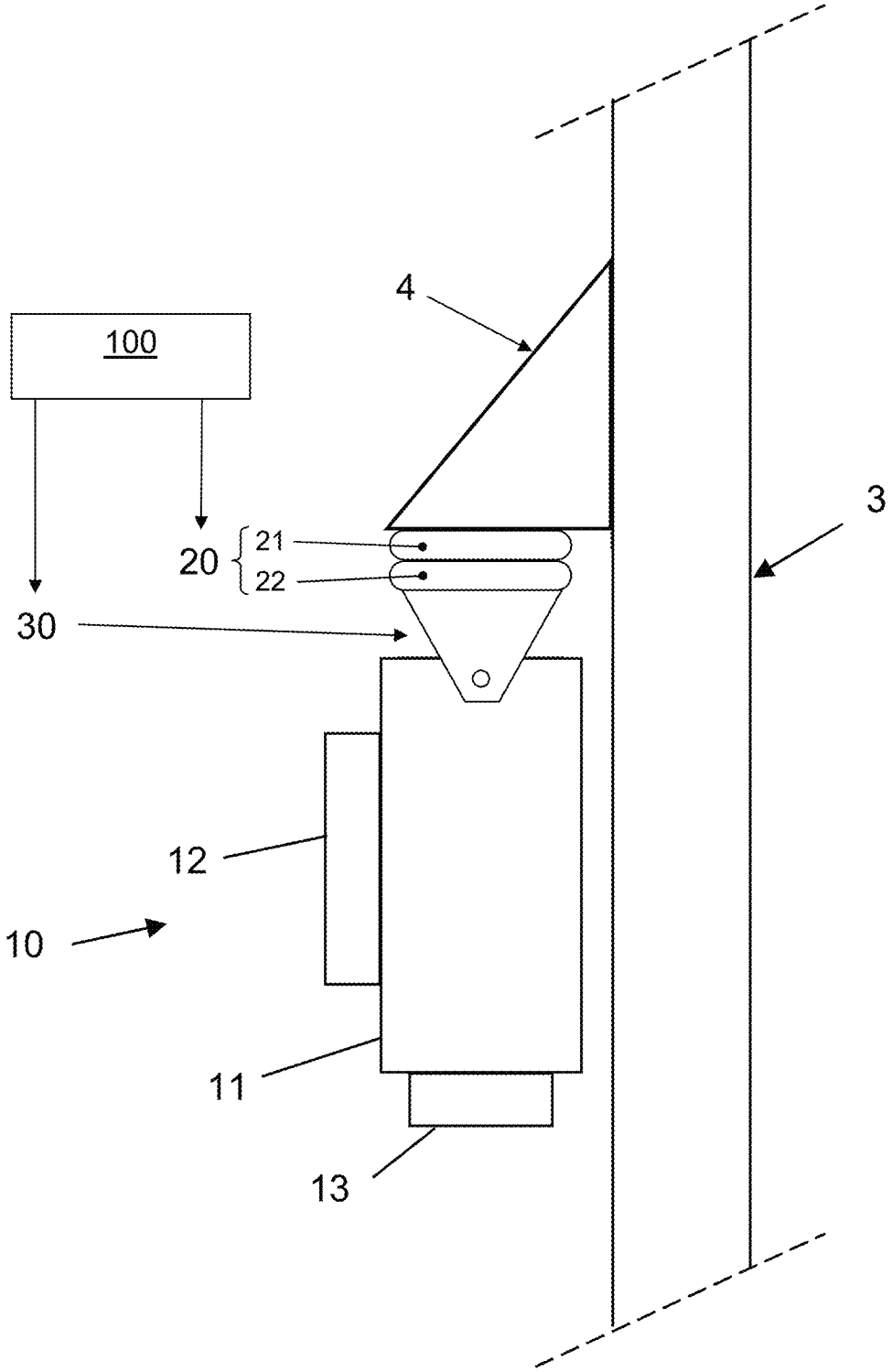
FIG. 4 schematically illustrates a vibration hammer according to another embodiment.

It should be clear to a person skilled in the art that the present invention is not limited to the exemplary embodiments discussed above, but that several variations and modifications are possible within the protective scope of the invention as defined in the appending claims. For instance, two or more functions may be performed by one single entity. Further, the order of the couplings 20 and 30 may be different, as shown in FIGS. 2 and 4.

Even if certain features are recited in different dependent claims, the present invention also relates to an embodiment comprising these features in common. Even if certain features have been described in combination with each other, the present invention also relates to an embodiment in which one or more of these features are omitted. Features which have not been explicitly described as being essential may also be omitted. Any reference signs in a claim should not be construed as limiting the scope of that claim.

The invention claimed is:

1. A pile driving apparatus comprising:

a guide mast configured to be held vertically by a pile driving vehicle;

a support carriage displaceable along a longitudinal direction of the guide mast and guided by the guide mast;

a vibration hammer comprising:

a hammer main body comprising:

a vibrations generator capable of generating driving vibrations;

a top end;

a lower end; and a side extending between the top end and the lower end, generally parallel to the longitudinal direction of the guide mast;

a first clamping means arranged at the side and configured to hold and clamp a pile at any position along a length of the pile; and a second clamping means arranged at the lower end and configured to hold and clamp the pile at a top end of the pile;

couplings connected between the support carriage and the vibration hammer comprising:

a rotator coupling connected to the support carriage and configured for rotating the vibration hammer with respect to a vertical axis; and a tilt coupling connected between the rotator coupling and the vibration hammer and configured for tilting the vibration hammer with respect to a horizontal axis;

rotator drive means configured for adjusting a rotational position of the vibration hammer with respect to the vertical axis;

tilt drive means configured for adjusting a tilt angle of the vibration hammer with respect to the horizontal axis; and control means configured for controlling the operation of the rotator drive means and the tilt drive means.

2. The pile driving apparatus according to claim 1, wherein the support carriage comprises a support platform extending substantially perpendicular to the longitudinal direction of the guide mast.

3. The pile driving apparatus according to claim 1 further comprising down-force generating means configured for exerting additional down-force on the support carriage.

4. The pile driving apparatus according to claim 3, wherein the down-force generating means comprise a cylinder-driven telescopic arm.

5. The pile driving apparatus according to claim 3, wherein the down-force generating means comprise carriage driving means configured for driving displacement of the support carriage along the guide mast.

6. The pile driving apparatus according to claim 5, wherein the carriage driving means comprise a winched cable.

7. The pile driving apparatus according to claim 5, wherein the carriage driving means comprise a motor-driven cogwheel in engagement with a rack.

8. A method of operating a pile driving apparatus comprising a guide mast configured to be held vertically by a pile driving vehicle, a support carriage displaceable along a longitudinal direction of the guide mast and guided by the guide mast, a vibration hammer comprising a hammer main body comprising a vibrations generator capable of generating driving vibrations, a top end, a lower end, and a side extending between the top end and the lower end, generally parallel to the longitudinal direction of the guide mast, the vibration hammer further comprising a first clamping means arranged at the side and configured to hold and clamp a pile at any position along a length of the pile and a second clamping means arranged at the lower end and configured to hold and clamp the pile at a top end of the pile, the pile driving apparatus further comprising couplings connected between the support carriage and the vibration hammer comprising a rotator coupling connected to the support carriage and configured for rotating the vibration hammer with respect to a vertical axis, and a tilt coupling connected between the rotator coupling and the vibration hammer and configured for tilting the vibration hammer with respect to a horizontal axis, rotator drive means configured for adjusting a rotational position of the vibration hammer with respect to the vertical axis, tilt drive means configured for adjusting a tilt angle of the vibration hammer with respect to the horizontal axis, and control means configured for controlling the operation of the rotator drive means and the tilt drive means, the method comprising:

driving the support carriage to a relatively low position with respect to the pile;

operating the first clamping means to clamp a side portion of the pile;

operating the vibration hammer to drive the pile down into the ground over a first portion of the length of the pile while the pile is being clamped by the first clamping means;

driving the support carriage to a higher position to lift the vibration hammer above the top end of the pile;

operating the second clamping means to clamp the top end of the pile; and operating the vibration hammer to drive the pile down into the ground over a second portion of the length of the pile while the pile is being clamped by the second clamping means.

9. The method according to claim 8 further comprising, before operating the vibration hammer, operating the rotator coupling to rotate the pile around the vertical axis.

10. The method according to claim 8 further comprising operating the tilt coupling to tilt the pile from a horizontal orientation to a vertical orientation.

* * * * *